United States Patent [19]

Tucker

[11] Patent Number: 5,004,432

[45] **Date of Patent: * Apr. 2, 1991**

[54] ELECTRICAL CONNECTOR

[75] Inventor: Donald L. Tucker, Redwood City, Calif.

[73] Assignee: Raychem Corporation, Menlo Park, Calif.

[ * ] Notice: The portion of the term of this patent subsequent to Mar. 26, 2008 has been disclaimed.

[21] Appl. No.: 415,820

[22] Filed: Oct. 2, 1989

[51] Int. Cl.[5] ..... H01R 4/24; H01R 19/08

[52] U.S. Cl. ..... 439/417; 439/696

[58] Field of Search ..... 439/417, 621, 622, 687, 439/695–697; 337/197, 198

[56] References Cited

U.S. PATENT DOCUMENTS

| | | | |
|---|---|---|---|
| 1,953,966 | 4/1934 | Lynch | 439/687 |
| 3,858,144 | 12/1974 | Bedard et al. | 219/549 |
| 3,861,029 | 1/1975 | Smith-Johannsen et al. | 29/610.1 |
| 4,188,276 | 2/1980 | Lyons et al. | 219/528 |
| 4,388,607 | 6/1983 | Toy et al. | 219/549 |
| 4,426,339 | 1/1984 | Kamath et al. | 264/22 |
| 4,436,986 | 3/1984 | Carlson | 361/2 |
| 4,443,050 | 4/1984 | Taylor | 439/622 |
| 4,459,473 | 7/1984 | Kamath | 219/553 |
| 4,679,877 | 7/1987 | Ahroni | 439/622 |
| 4,701,138 | 10/1987 | Key | 439/417 |
| 4,822,983 | 4/1989 | Bremmer et al. | 219/505 |
| 4,826,449 | 5/1989 | Debortoli et al. | 439/417 |
| 4,834,664 | 5/1989 | Lin | 439/145 |

*Primary Examiner*—Gary F. Paumen

*Attorney, Agent, or Firm*—Marguerite E. Gerstner; Timothy H. P. Richardson; Herbert G. Burkard

[57] ABSTRACT

An electrical connector for an electrical lead which has a first conductor and a second conductor. The connector has a first component, a conductor-receiving member, into which the conductors are inserted, and second component, a conductor-connecting member. The conductor-receiving member and the conductor-connecting member are movable relative to one another between a unique mated configuration and a plurality of demated configurations. The conductor-receiving member is preferably transparent in order to visually determine the correct positioning of the conductors.

19 Claims, 3 Drawing Sheets

ELECTRICAL CONNECTOR

BACKGROUND OF THE INVENTION

Cross-Reference to Related Applications

This application is related to copending, commonly assigned Application No. 07/415,757, filed contemporaneously with this application, the disclosure of which is incorporated herein by reference.

Field of the Invention

This invention relates to electrical connectors for electrical leads.

Introduction to the Invention

It is often necessary to make an electrical connection to an electrical lead, e.g. to attach an electrical plug in order to apply power or to splice two leads together. Conventional connection devices often require that the conductors comprising the electrical lead be twisted around terminal posts or be screwed into position. This requires manual dexterity and care to insure that the conductors are properly aligned and separated from one another.

SUMMARY OF THE INVENTION

I have now discovered that if the connector comprises a first component which acts as a template for insertion of the conductors and a second component with which the first component can be mated in a unique configuration, an effective, craft-insensitive connection can be made reliably. The first component, "the conductor-receiving member", provides a means of precisely positioning and separating each conductor. Because the first component can be mated to the second component, "the conductor-connecting member", only in a single configuration, improper installation is avoided. In its properly mated configuration, the connector preferably provides strain relief for the electrical lead and splash-proofing for the connections. Thus, in a first aspect, this invention provides an electrical connector for an electrical lead comprising a first conductor and a second conductor, which connector comprises (1) a conductor-receiving member which comprises
(a) a first channel in which the first conductor can be placed, and
(b) a second channel in which the second conductor can be placed; and
(2) a conductor-connecting member which comprises
(a) a first conductor-contact section,
(b) a first connection-making section,
(c) a second conductor-contact section, and
(d) a second connection-making section;

the conductor-receiving member and the conductor-connecting member being (i) movable relative to each other between a unique mated configuration and a plurality of demated configurations;
(ii) such that in at least some of the demated configurations, the first conductor can be placed in the first channel and the second conductor can be placed in the second channel;
(iii) such that if the first conductor has been placed in the first channel and the second conductor has been placed in the second channel, the conductor-receiving member with the conductors placed therein and the conductor-connecting member can then be brought into the mated configuration, in which mated configuration the first conductor makes physical and electrical contact with the first conductor-contact section and the second conductor makes physical and electrical contact with the second conductor-contact section; and
(iv) such that they cannot be brought into the mated configuration if the first conductor or the second conductor has been placed in direct physical contact with the respective conductor-contact section instead of being placed in the respective channel; and (3) closure means for maintaining the conductor-receiving member and the conductor-connecting member in the mated configuration.

In a second aspect, this invention provides an assembly which comprises (A) an electrical lead comprising a first conductor and second conductor;
(B) an electrical connector which comprises
(1) a conductor-receiving member which comprises
(a) a first channel in which the first conductor has been placed, and
(b) a second channel in which the second conductor has been placed; and
(2) a conductor-connecting member which comprises
(a) a first conductor-contact section,
(b) a first connection-making section,
(c) a second conductor-contact section, and
(d) a second connection-making section;

the conductor-receiving member and the conductor-connecting member being (i) movable relative to each other between a unique mated configuration and a plurality of demated configurations;
(ii) such that in at least some of the demated configurations, the first conductor can be placed in the first channel and the second conductor can be placed in the second channel;
(iii) such that if the first conductor has been placed in the first channel and the second conductor has been placed in the second channel, the conductor-receiving member with the conductors placed therein and the conductor-connecting member can then be brought into the mated configuration, in which mated configuration the first conductor makes physical and electrical contact with the first conductor-contact section and the second conductor makes physical and electrical contact with the second conductor-contact section; and
(iv) such that they cannot be brought into the mated configuration if the first conductor or the second conductor has been placed in direct physical contact with the respective conductor-contact section instead of being placed in the respective channel; and (C) closure means for maintaining the conductor-receiving member and the conductor-connecting member in the mated configuration, wherein the conductor-receiving member and the conductor-connecting member are in the mated configuration.

DETAILED DESCRIPTION OF THE INVENTION

The connector of the invention is useful for connecting any type of electrical lead which comprises a first conductor and a second conductor, e.g. an electric power cord. Of particular interest is an electrical connection made to a strip heater, i.e. an elongate heating element which comprises at least two electrodes. For this connection, the first conductor is one electrode of the heater and the second conductor is the other electrode of the heater. The strip heater may comprise a conductive polymer, i.e. a composition in which a particulate conductive filler is dispersed or otherwise distributed in a polymeric component. Particularly preferred are self-regulating conductive polymer heaters, i.e. those which exhibit PTC (positive temperature coefficient) behavior. The electrodes of a self-regulating heater are generally elongate metal wires or braid which are parallel and spaced apart. They are attached to or embedded in a resistive element which comprises the conductive polymer and is often in the form of a continuous strip. In order to provide environmental protection and electrical insulation, it is common for the resistive element and the electrodes to be covered by a dielectric layer, e.g. an insulating polymer jacket. A metallic grounding braid is often present over the dielectric layer in order to provide physical reinforcement and a means of electrically grounding the strip heater. Self-regulating conductive polymer heaters which exhibit PTC behavior, suitable conductive polymer compositions, and circuits comprising them, are disclosed in U.S. Pat. Nos. 3,585,144 (Bedard et al), 3,861,029 (Smith-Johannsen et al), 4,188,276 (Lyons et al), 4,388,607 (Toy et al), 4,426,339 (Kamath et al), 4,459,473 (Kamath) and 4,822,983 (Bremner et al) and copending, commonly assigned application Ser. No. 404,730 (Emmett), filed Sept. 8, 1989. The disclosure of each of these patents and applications is incorporated herein by reference.

Figure 1A:
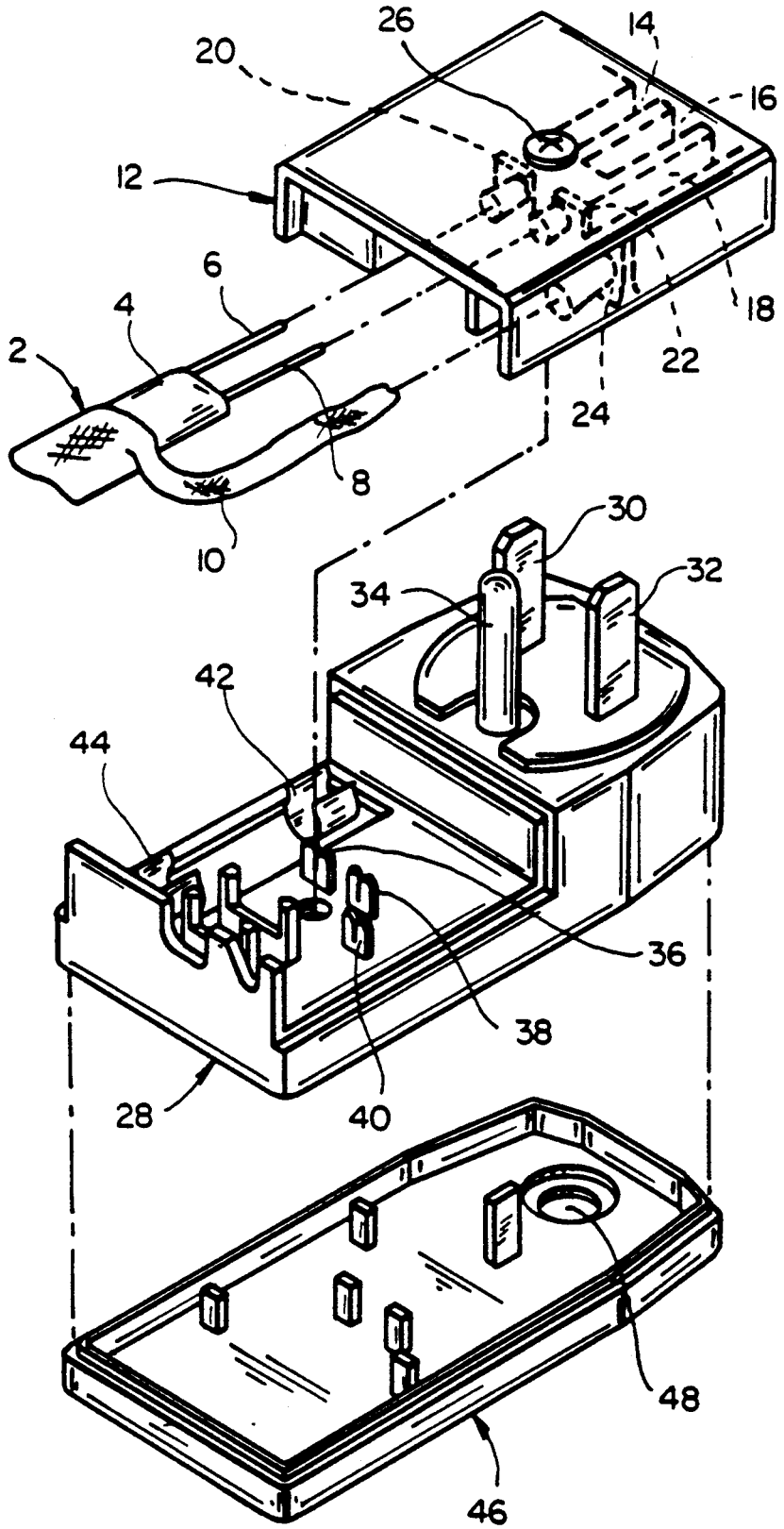
FIG. 1A is an exploded view of a connector of the invention.

The connector of the invention is shown in an exploded view in FIG. 1A. An electrical lead 2 is a strip heater which comprises a resistive element 4, and embedded therein, a first conductor 6 and a second conductor 8. A metallic grounding braid 10 surrounds the heater and a portion of the braid is peeled away from the first and second conductors 6, 8 and is twisted to form a grounding lead. Both the first conductor 6 and the second conductor 8 have been stripped of the conductive polymer which comprises the resistive element 4 to allow easy insertion into the conductor-receiving member 12. For other types of electrical leads, e.g. insulated wires, it may not be desirable to remove the polymeric insulating material. The conductor-receiving member 12 comprises a transparent, insulating polymer, e.g. polycarbonate, which allows the user to determine whether the conductors are correctly positioned. The conductor-receiving member 12 comprises a first channel 14, a second channel 16, and a third channel 18 designed for the insertion of the first conductor 6, the second conductor 8, and the grounding lead 10, respectively. Each channel is a tunnel which has a frusto-conical opening; both the tunnel and the opening are sized so that the conductors inserted in them can be held by frictional forces. A radial opening 20, 22, 24 is cut through each tunnel to allow electrical connection of the inserted conductor to the appropriate conductor-contact section.

After the conductors are inserted into the conductor-receiving member 12, it is mated to the conductor-connecting member 28. As a result of the design of the conductor-receiving member 12, which may include positioning pins or other design elements which are not shown, there is a unique mated configuration. When the two pieces 12, 28 are mated, the first conductor 6 is in physical and electrical contact with the first conductor-contact section 36, the second conductor 8 is in physical and electrical contact with the second conductor-contact section 38, and the grounding lead 10 is in physical and electrical contact with the grounding-contact section 40. The first and second conductor-contact sections 36, 38 and the grounding-contact section 40 may comprise insulation-piercing means for use when the conductors are insulated with a polymeric jacket. Electrical contact to a power source, e.g. a wall outlet, is made by connection to a first connection-making section 30, a second connection-making section 32, and a ground connection-making section 34. All three connection-making sections are in the form of prongs for insertion into the outlet.

The conductor-connecting member 28 further comprises first and second fuse-contact sections 42, 44 designed to receive a fuse. The first fuse-contact section 42 is electrically connected to the first connection-making section 30 and the second fuse-contact section 44 is electrically connected to the first conductor-contact section 36. When the first and second connection-making sections 30, 32 (e.g. the prongs) are connected to a source of power, the current passes through the fuse. If, in addition to the fuse, the connector comprises a signal member 50, e.g. a light such as a light emitting diode (LED), which is electrically connected between the first conductor-contact section 36 and the first connection-making section 32, the electrical continuity of the fuse can be monitored visually. A bell, a switch, or another component may be used if a audio or electronic signal is desired. When the electrical lead comprises a self-regulating strip heater it is particularly preferred that a very fast acting fuse be used. These fuses have little, if any, intentional delay in the overload region and "trip", i.e. open, very rapidly when the current in the circuit comprising the fuse exceeds the rated value of the fuse. When the electrical connector comprises a plug, it is preferred that a very fast-acting ceramic ferrule fuse with a current rating of 10 amperes and a voltage rating of 125/250 volts be used. Such fuses are available, for example, from the Bussman Division of Cooper Industries under the name Buss GBB TM -10. While it is possible to use one of the measures disclosed in U.S. Pat. No. 4,822,983 (Bremner et al) in conjunction with this invention, I have found that, when a fuse as first described is employed, excellent results can be obtained without using a sensor conductor as disclosed in that patent. A switch or other component may be used in place of the fuse for some applications.

Figure 1B:
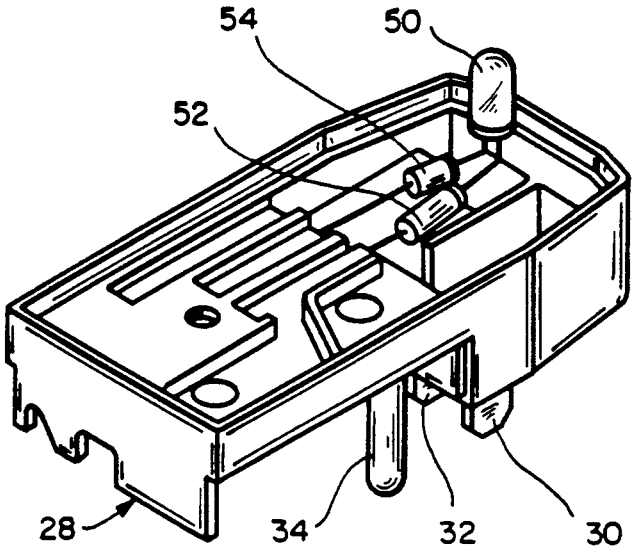
FIG. 1B is a perspective view of the bottom of a component of the connector of the invention.

The embodiment shown in FIG. 1A also comprises a base 46 for the conductor-connecting member 28 which can be welded, glued, or snapped into place. A signal port 48 is positioned so that the signal member 50 will be visible. FIG. 1B shows the bottom of the conductor-connecting member 28 without the base 46. The signal member 50, an LED, and first and second resistors 52, 54 are visible. It is apparent that the first conductor-contact section 36 and the second fuse-contact section 44 are made from a single piece of metal, e.g. brass. In this embodiment the second conductor-contact section 38 and the second connection-making section 32 are made from a single piece of metal, as are the first fuse-contact section 42 and the first connection-making section 30.

The conductor-receiving member 12 and the conductor-connecting member 28 are maintained in position by a closure means 26, e.g. a screw or clamp. The two members 12, 28 cannot be brought into the mated configuration if the first conductor 6 has been placed in direct physical contact with the first conductor-contact section 36 or if the second conductor 8 has been placed in direct physical contact with the second conductor-contact section 38, rather than being placed in the appropriate channel. When mated properly, the plug provides adequate stain relief to the electrical lead. A minimum pull force of 20 pounds on the electrical lead is achieved.

Figure 2:
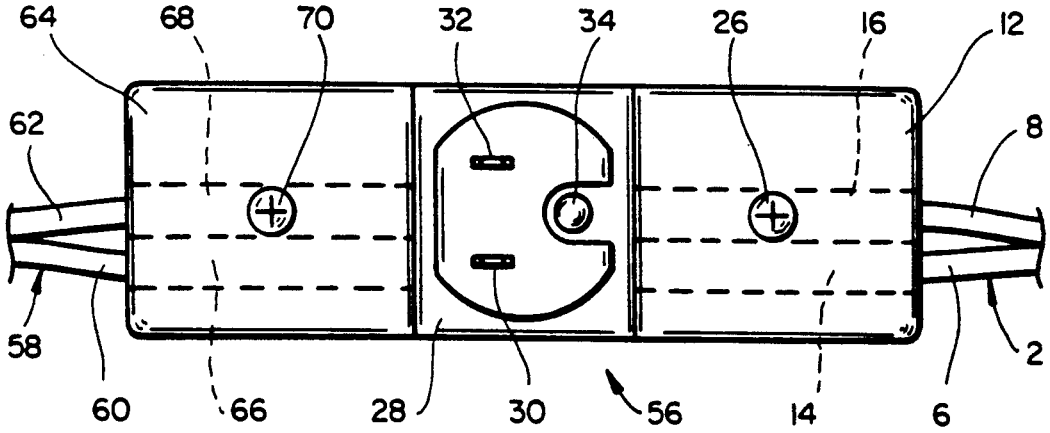
FIG. 2 is a top view of another connector of the invention.

FIG. 2 illustrates a connector 56 which is designed to connect a first electrical lead 2 comprising first and second conductors 6, 8 and a second electrical lead 58 comprising third and fourth conductors 60, 62. In this connector 56, there are two conductor-receiving members 12, 64. The second conductor-receiving member 64 comprises two channels 66, 68 for insertion of the third and fourth conductors 60, 62. A second closure means 70 maintains the second conductor-receiving member 64 in the mated configuration. In the mated configuration, the third conductor 60 makes physical and electrical contact with the first connection making-section 30 and the fourth conductor 62 makes physical and electrical contact with the second connection-making section 32.

Figure 3:
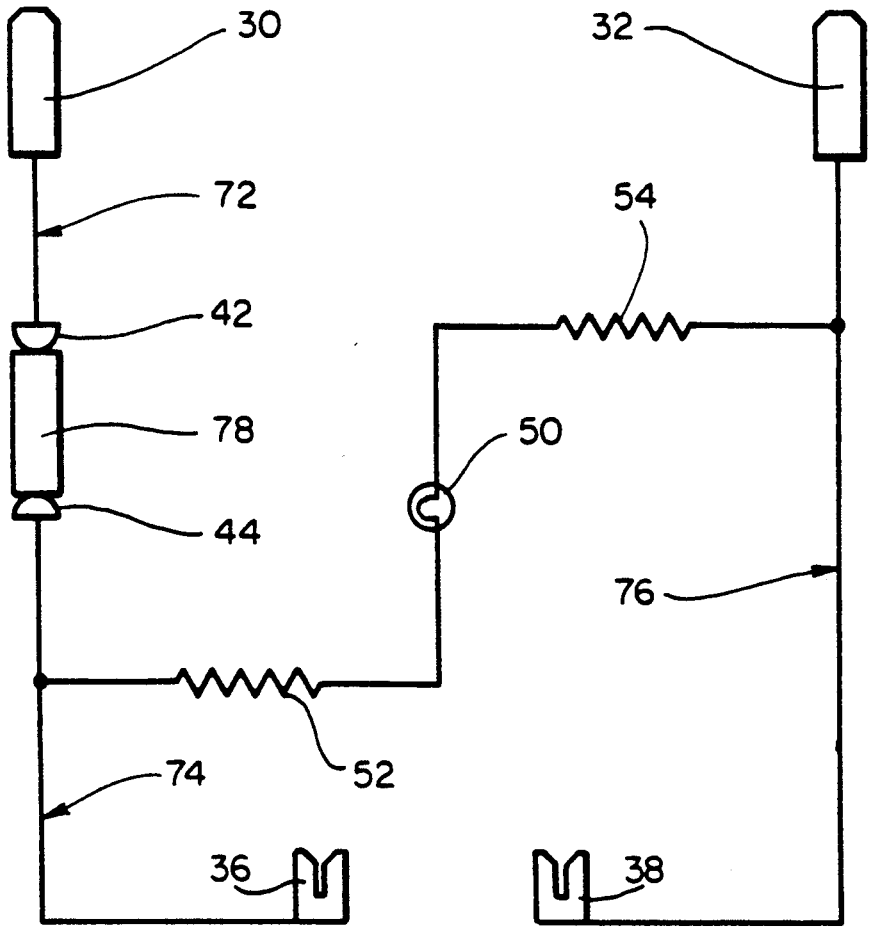
FIG. 3 is a schematic circuit diagram of a connector of the invention.

FIG. 3 is a schematic circuit diagram for a connector of the invention which comprises a fuse. A first contact member 72 comprises a first prong 30 (i.e. a first connection-making section) and a first fuse-contact section 42. A second contact member 74 comprises a second fuse-contact section 44 and a first conductor-contact section 36. A third contact member 76 comprises a second conductor-contact section 38 and a second prong 32 (i.e. a second connection-making section). A signal member 50 is electrically connected between the second and third contact members 74, 76 and is in series with first and second resistors 52, 54. When the first and second prongs 30, 32 are inserted into a power outlet, the signal member 50 provides a signal if a fuse 78 connects the first and second fuse-contact sections 42, 44. No signal is provided if there is no electrical connection.

What is claimed is:

1. An electrical connector for a first electrical lead comprising a first conductor and a second conductor, which connector comprises (1) a conductor-receiving member which comprises
  (a) a first channel in which the first conductor can be placed, and
  (b) a second channel in which the second conductor can be placed; and
(2) a conductor-connecting member which comprises
  (a) a first conductor-contact section,
  (b) a first connection-making section,
  (c) a second conductor-contact section, and
  (d) a second connection-making section;

the conductor-receiving member and the conductor-connecting member being (i) movable relative to each other between a unique mated configuration and a demated configuration;
(ii) such that in the demated configuration, the first conductor can be placed in the first channel and the second conductor can be placed in the second channel;
(iii) such that if the first conductor has been placed in the first channel and the second conductor has been placed in the second channel, the conductor-receiving member with the conductors placed therein and the conductor-connecting member can then be brought into the mated configuration, in which mated configuration the first conductor makes physical and electrical contact with the first conductor-contact section and the second conductor makes physical and electrical contact with the second conductor-contact section; and
(iv) such that they cannot be brought into the mated configuration if the first conductor or the second conductor has been placed in direct physical contact with the respective conductor-contact section instead of being placed in the respective channel; and (3) closure means for maintaining the conductor-receiving member and the conductor-connecting member in the mated configuration.

2. A connector according to claim 1 wherein the conductor-receiving member is composed of insulating material.

3. A connector according to claim 2 wherein the insulating material is transparent.

4. A connector according to claim 1 wherein the first and second conductors can be placed into the first and second channels respectively so that each conductor is retained therein by frictional forces.

5. A connector according to claim 1 wherein each of the first and second channels is in the form of a tunnel having a radial opening therein, and when the conductor-receiving member and the conductor-connecting member are in the mated configuration, the respective conductor-contact sections pass through the radial openings.

6. A connector according to claim 5 wherein the conductor-receiving member further comprises a third channel in which a ground lead can be placed when the conductor-receiving member and the conductor-connector member are in the demated configuration, and the conductor-connecting member further comprises a ground-contact section which contacts the ground lead in the mated configuration and a ground connection-making section.

7. A connector according to claim 5 wherein each of the tunnels has a frusto-conical entranceway.

8. A connector according to claim 1 wherein at least one of (1) the combination of the first conductor-contact section and the first connection-making section, and (2) the combination of the second conductor-contact section and the second connection-making section, is made from a single piece of metal.

9. A connector according to claim 1 wherein the conductor-connecting member further comprises a first fuse-contact section which is electrically connected to the first connection-making section and a second fuse-contact section which is electrically connected to the first conductor-contact section, the fuse-contact sections being capable of receiving a fuse.

10. A connector according to claim 1 wherein the conductor-connecting member further comprises a switch which is electrically connected between the first conductor-contact section and the first connection-making section.

11. A connector according to claim 1 wherein the first and second connection-making sections are in the form of prongs for insertion into an electrical socket.

12. A connector according to claim 1 wherein the first and second channels are sized to receive first and second conductors respectively which have been stripped of electrical insulation.

13. A connector according to claim 1 wherein (1) the first and second channels are sized to receive first and second conductors which are insulated with an electrically insulating material and (2) the first and second conductor-contact sections comprise insulation-piercing means which pierce the electrically insulating material when the first and second conductors are inserted into the conductor-receiving member and the conductor-receiving member and the conductor-connecting member are then brought into the mated configuration.

14. A connector according to claim 1 which is suitable for connecting said first electrical lead comprising said first and second conductors and a second electrical lead comprising third and fourth conductors, and which comprises (4) conductor-receiving member which comprises
  (a) a third channel in which the third conductor can be placed, and
  (b) a fourth channel in which the fourth conductor can be placed,
  the second conductor-receiving member being
  (i) movable relative to the conductor-connecting member between a second unique mated configuration and a demated configuration;
  (ii) such that in the demated configuration, the third conductor can be placed in the third channel and the fourth conductor can be placed in the fourth channel;
  (iii) such that if the third conductor has been placed in the third channel and the fourth conductor has been placed in the fourth channel, the second conductor-receiving member with the third and fourth conductors placed therein and the conductor-connecting member can then be brought into the second mated configuration, in which mated configuration the third conductor makes physical and electrical contact with the first connection-making section and the fourth conductor makes physical and electrical contact with the second connection-making section; and
  (iv) such that they cannot be brought into the second mated configuration if the third or the fourth conductor has been placed in direct physical contact with the first connection-making section or the second connection-making section instead of being placed in the third channel or the fourth channel; and (5) a second closure means for maintaining the second conductor-receiving member and the conductor-connecting member in the second mated configuration.

15. A connector according to claim 14 wherein a fuse, a switch, or a light is electrically connected between the first conductor-contact section and the first connection-making section.

16. An assembly which comprises (A) an electrical lead comprising a first conductor and second conductor;

(B) an electrical connector which comprises
  (1) a conductor-receiving member which comprises
    (a) a first channel in which the first conductor has been placed, and
    (b) a second channel in which the second conductor has been placed; and
  (2) a conductor-connecting member which comprises
    (a) a first conductor-contact section,
    (b) a first connection-making section,
    (c) a second conductor-contact section, and
    (d) a second connection-making section;

the conductor-receiving member and the conductor-connecting member being
  (i) movable relative to each other between a unique mated configuration and a demated configuration;
  (ii) such that in the demated configuration, the first conductor can be placed in the first channel and the second conductor can be placed in the second channel;
  (iii) such that if the first conductor has been placed in the first channel and the second conductor has been placed in the second channel, the conductor-receiving member with the conductors placed therein and the conductor-connecting member can then be brought into the mated configuration, in which mated configuration the first conductor makes physical and electrical contact with the first conductor-contact section and the second conductor makes physical and electrical contact with the second conductor-contact section; and
  (iv) such that they cannot be brought into the mated configuration if the first conductor or the second conductor has been placed in direct physical contact with the respective conductor-contact section instead of being placed in the respective channel; and (C) closure means for maintaining the conductor-receiving member and the conductor-connecting member in the mated configuration, wherein the conductor-receiving member and the conductor-connecting member are in the mated configuration.

17. An assembly according to claim 16 wherein the electrical lead comprises a strip heater.

18. An assembly according to claim 16 wherein the electrical lead comprises a self-regulating conductive polymer heater.

19. An assembly according to claim 16 wherein the electrical lead comprises (a) a conductive polymer resistive element in the form of a continuous strip and (b) parallel spaced-apart electrodes which are embedded in the conductive polymer resistive element.

* * * * *